US009499380B1

(12) United States Patent
Eischens

(10) Patent No.: US 9,499,380 B1
(45) Date of Patent: Nov. 22, 2016

(54) HOOK ATTACHMENT FOR A FORKLIFT VEHICLE

(71) Applicant: Jerry Eischens, Los Gatos, CA (US)

(72) Inventor: Jerry Eischens, Los Gatos, CA (US)

( * ) Notice: Subject to any disclaimer, the term of this patent is extended or adjusted under 35 U.S.C. 154(b) by 0 days.

(21) Appl. No.: 14/700,790

(22) Filed: Apr. 30, 2015

(51) Int. Cl.
*B66C 1/34* (2006.01)
*B66F 9/18* (2006.01)

(52) U.S. Cl.
CPC ..... *B66F 9/18* (2013.01)

(58) Field of Classification Search
CPC ..... B66F 9/18; B66F 9/12
USPC ..... 294/82.1; 414/607, 666, 685, 785, 608; 187/237
See application file for complete search history.

(56) References Cited

U.S. PATENT DOCUMENTS 883,945 A * 4/1908 Flynn ..... B66C 1/34 294/82.1
1,045,882 A * 12/1912 Price ..... B66C 1/34 24/698.1
2,493,282 A * 1/1950 Criswell ..... B66C 1/36 24/599.2
2,558,388 A * 6/1951 Richardson ..... B66F 9/061 414/607
3,264,026 A 8/1966 Hansen
3,409,156 A * 11/1968 Mills ..... B21C 47/242 294/81.6
3,759,399 A * 9/1973 Glass ..... B66C 1/22 212/180
3,930,585 A * 1/1976 Lynch ..... B66F 9/18 248/339
4,073,175 A * 2/1978 Seamon ..... B66F 9/187 294/68.3
4,858,977 A * 8/1989 Mitchell ..... B66C 1/34 294/82.1
6,081,975 A * 7/2000 Norrby ..... F16B 45/00 24/265 H
6,601,892 B2 8/2003 Scarborough
7,308,972 B2 12/2007 Pax et al.

* cited by examiner

*Primary Examiner* — Gabriela Puig
(74) *Attorney, Agent, or Firm* — Crossley & Stevenson Intellectual Property Law

(57) ABSTRACT

A hook attachment for a forklift vehicle including a hook having a rectangular upper half and a hooked lower half, a rectangular aperture disposed within the upper half of the hook, and a lip medially disposed within the aperture on an internal surface of a top edge of the upper half. A length of the aperture substantially conforms to a width of a fork on a forklift vehicle. The upper half of the hook is configured to slidably engage the fork through the aperture. The lip is configured to securingly engage an opening in a top side of the fork.

4 Claims, 3 Drawing Sheets

HOOK ATTACHMENT FOR A FORKLIFT VEHICLE

BACKGROUND OF THE INVENTION

Various types of forklift attachments are known in the prior art. However, what has been needed is a hook attachment for a forklift vehicle including a hook having a rectangular upper half and a hooked lower half, a rectangular aperture disposed within the upper half of the hook, and a lip medially disposed within the aperture. What has been further needed is for a length of the aperture to substantially conform to a width of a fork on a forklift vehicle. Lastly, what has been need is for the upper half of the hook to be configured to slidably engage the fork through the aperture and for the lip to be configured to securingly engage an opening in a top side of the fork. This attachment device thus enables a forklift operator to better grasp and lift a heavy chain with the hooked lower half. Although the hook attachment for a forklift vehicle can securely lift numerous types of heavy objects, this attachment is specifically structured to securely and safely lift heavy chains.

FIELD OF THE INVENTION

The present invention relates to forklift attachments, and more particularly, to a hook attachment for a forklift vehicle.

SUMMARY OF THE INVENTION

The general purpose of the present hook attachment for a forklift vehicle, described subsequently in greater detail, is to provide a forklift attachment which has many novel features that result in a hook attachment for a forklift vehicle which is not anticipated, rendered obvious, suggested, or even implied by prior art, either alone or in combination thereof.

To accomplish this, the present hook attachment for a forklift vehicle comprises a hook having a rectangular upper half and a hooked lower half. The hook can optionally be steel. The upper half has a top edge, a bottom edge, a right edge, and a left edge. Each of the top edge, the bottom edge, the right edge, and the left edge has an external surface and an internal surface. A rectangular aperture is disposed within the upper half of the hook. A length of the aperture substantially conforms to a width of a fork on a forklift vehicle. A lip is medially disposed within the aperture on the internal surface of the top edge of the upper half. The upper half of the hook is configured to slidably engage the fork through the aperture. The lip is configured to securingly engage an opening in a top side of the fork. The hooked lower half can optionally attach to a chain.

Thus has been broadly outlined the more important features of the present hook attachment for a forklift vehicle so that the detailed description thereof that follows may be better understood and in order that the present contribution to the art may be better appreciated.

BRIEF DESCRIPTION OF THE DRAWINGS

Figures

DETAILED DESCRIPTION OF THE DRAWINGS

With reference now to the drawings, and in particular FIGS. 1 through 5 thereof, an example of the instant hook attachment for a forklift vehicle employing the principles and concepts of the present hook attachment for a forklift vehicle and generally designated by the reference number 10 will be described.

Figure 1:
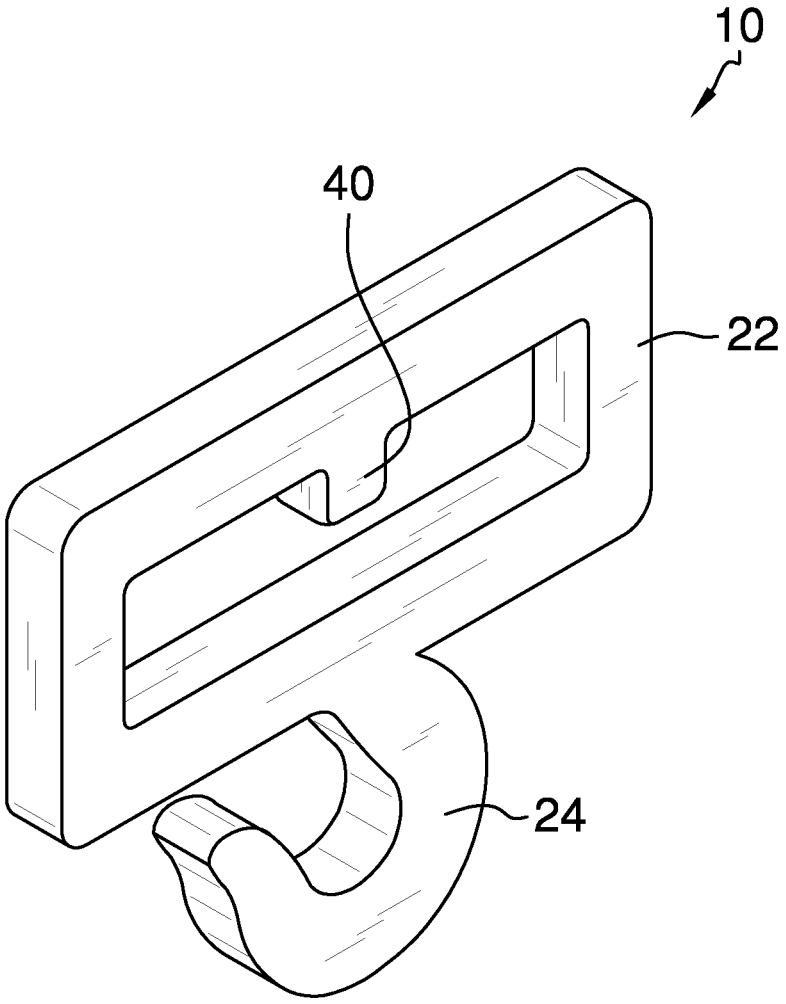
FIG. 1 is a front isometric view.
Figure 4:
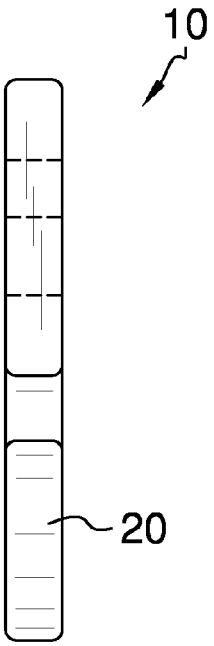
FIG. 4 is a side elevation view.
Figure 2:
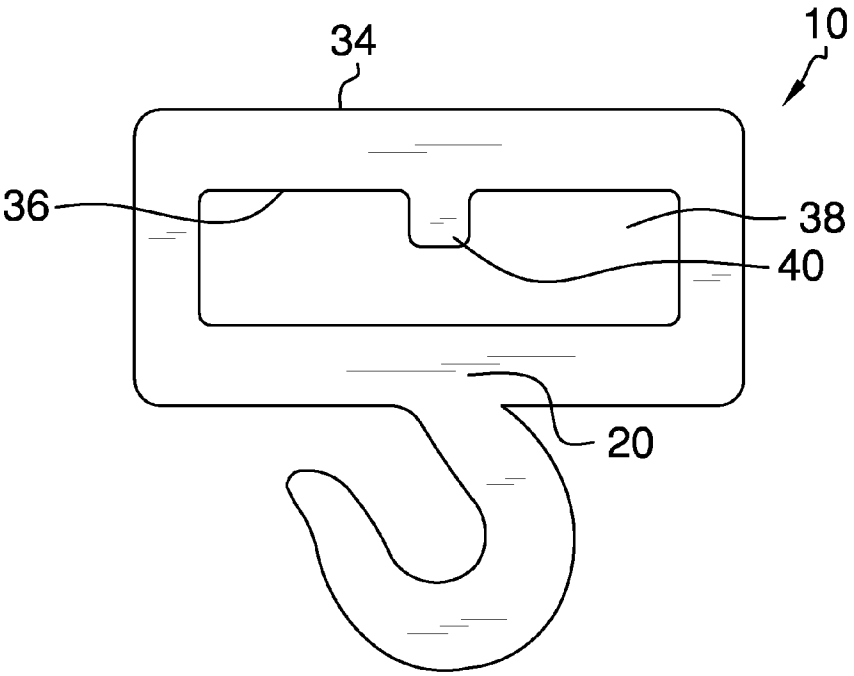
FIG. 2 is a front elevation view.
Figure 3:
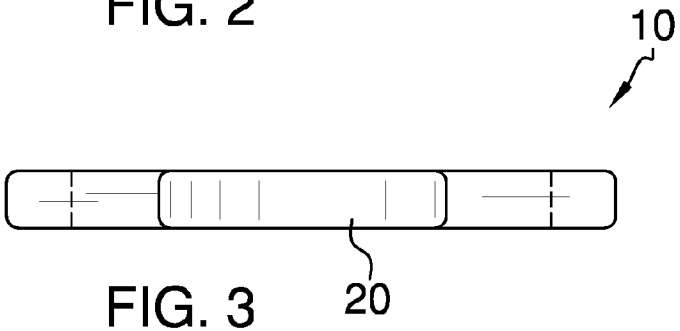
FIG. 3 is a bottom plan view.
Figure 5:
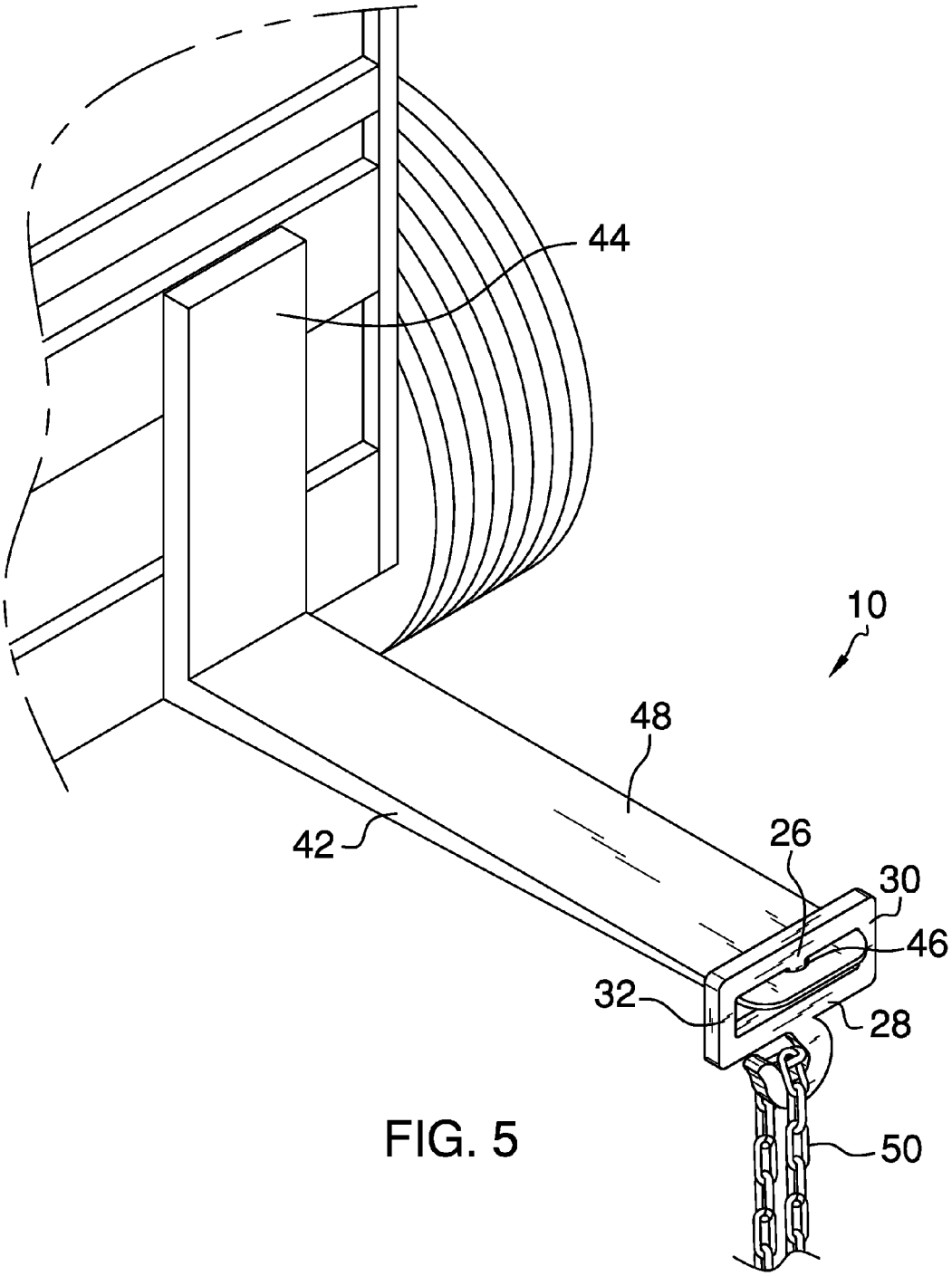
FIG. 5 is an in-use view.

Referring to FIGS. 1 through 5 the present hook attachment for a forklift vehicle 10 is illustrated. The hook attachment for a forklift vehicle 10 comprises a hook 20 having a rectangular upper half 22 and a hooked lower half 24. The upper half 22 has a top edge 26, a bottom edge 28, a right edge 30, and a left edge 32. Each of the top edge 26, the bottom edge 28, the right edge 30, and the left edge 32 has an external surface 34 and an internal surface 36. A single rectangular aperture 38 is medially disposed within the upper half 22 of the hook 20. A single rectangular lip 40 is medially disposed on the internal surface 36 of the top edge 26 of the upper half 22 and downwardly extended within the aperture 38. As best shown in FIG. 5, the upper half 22 of the hook 20 is configured to slidably engage a fork 42 on a forklift vehicle 44 through the aperture 38. The lip 40 is configured to securingly engage an opening 46 in a top side 48 of the fork 42. The hooked lower half 24 can optionally attach to a chain 50.

What is claimed is:

1. A hook attachment for a forklift vehicle comprising:

a hook having a rectangular upper half and a hooked lower half, the upper half having a top edge, a bottom edge, a right edge, and a left edge, each of the top edge, the bottom edge, the right edge, and the left edge having an external surface and an internal surface;

no more than one rectangular aperture medially disposed within the hook upper half;

wherein a length of the aperture substantially conforms to a width of a fork on the forklift vehicle; and a single rectangular lip medially and fixedly disposed on the internal surface of the upper half top edge and downwardly extended within the aperture;

wherein the hook upper half is configured to slidably engage the fork through the aperture;

wherein the lip is configured to securingly engage an opening in a top side of the fork.

2. The hook attachment for a forklift vehicle of claim 1 wherein the hooked lower half attaches to a chain.

3. The hook attachment for a forklift vehicle of claim 1 wherein the hook is made of steel.

4. A hook attachment for a forklift vehicle comprising:

a hook having a rectangular upper half and a hooked lower half, the upper half having a top edge, a bottom edge, a right edge, and a left edge, each of the top edge, the bottom edge, the right edge, and the left edge having an external surface and an internal surface;

wherein the hook is made of steel;

no more than one rectangular aperture medially disposed within the hook upper half;

wherein a length of the aperture substantially conforms to a width of a fork on the forklift vehicle; and a single rectangular lip medially and fixedly disposed on the internal surface of the upper half top edge and downwardly extended within the aperture;

wherein the hook upper half is configured to slidably engage the fork through the aperture;

wherein the lip is configured to securingly engage an opening in a top side of the fork;

wherein the hooked lower half attaches to a chain.

* * * * *